US008104844B2

(12) United States Patent
Fader

(10) Patent No.: US 8,104,844 B2
(45) Date of Patent: Jan. 31, 2012

(54) SLEEVE FOR REVERSIBLE CUTTING TOOL

(75) Inventor: Joseph Conwell Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 1374 days.

(21) Appl. No.: 11/711,002

(22) Filed: Feb. 27, 2007

(65) Prior Publication Data

US 2008/0206002 A1 Aug. 28, 2008

(51) Int. Cl.
*E21C 35/18* (2006.01)
*E21C 35/00* (2006.01)

(52) U.S. Cl. ..... 299/104; 299/101; 407/113

(58) Field of Classification Search ..... 407/113–116, 407/101, 118; 299/104, 113, 79.1, 102, 107, 299/101, 11; 408/199, 226
See application file for complete search history.

(56) References Cited

U.S. PATENT DOCUMENTS

| | | | | |
|---|---|---|---|---|
| 3,342,531 | A | 9/1967 | Krekeler | |
| 3,397,012 | A | 8/1968 | Krekeler | |
| 3,493,268 | A * | 2/1970 | Bower, Jr. | 299/110 |
| 3,519,309 | A | 7/1970 | Engle et al. | |
| 3,841,707 | A * | 10/1974 | Kniff et al. | 299/84.1 |
| 3,841,708 | A * | 10/1974 | Kniff et al. | 299/104 |
| 4,084,856 | A * | 4/1978 | Emmerich et al. | 299/104 |
| RE29,900 | E * | 2/1979 | Kniff | 299/104 |
| 4,688,856 | A | 8/1987 | Elfgen | |
| 4,728,153 | A * | 3/1988 | Ojanen et al. | 299/107 |
| 5,106,166 | A * | 4/1992 | O'Neill | 299/104 |
| 5,415,462 | A | 5/1995 | Massa | |
| 5,628,549 | A | 5/1997 | Ritchey et al. | |
| 5,730,502 | A | 3/1998 | Montgomery, Jr. | |
| 5,810,102 | A | 9/1998 | Stewart | |
| 6,712,431 | B1 | 3/2004 | Bosch et al. | |

(Continued)

FOREIGN PATENT DOCUMENTS

DE 77 20 281 U 11/1977

(Continued)

OTHER PUBLICATIONS

Alpine Miner AM 75 specification sheet, published by Voest-Alpine Bergtechnik Ges. M.b.H., Zeltweg, Austria (Jul. 12, 2006), 2 pages.

(Continued)

*Primary Examiner* — Will Fridie, Jr.
(74) *Attorney, Agent, or Firm* — Morgan, Lewis & Bockius LLP

(57) ABSTRACT

A cutting tool has a first cutting end, a second cutting end, a shoulder at an interface between the first cutting end and the second cutting end, and a shield removably mounted on one of the first cutting end and second cutting end. The cutting ends each have a cutting tip at a distal end, a body portion, a recess in the body portion and a retainer positioned in the recess. Cutting ends can be mirror images of each other, or may be non-mirror imaged, for example with different gage lengths, to accommodate different operating conditions. One of the cutting ends is mounted in a holder and the shield protects the retainer and recess features on the operating cutting end. A combination of a reversible cutting tool and a sleeve and/or block holder system, an apparatus for cutting, a sleeve per se and a shield per se are also disclosed.

40 Claims, 5 Drawing Sheets

U.S. PATENT DOCUMENTS

| | | | | |
|---|---|---|---|---|
| 6,846,045 | B2 * | 1/2005 | Sollami | 299/105 |
| 7,594,703 | B2 * | 9/2009 | Hall et al. | 299/111 |
| 7,611,209 | B2 * | 11/2009 | Fader | 299/104 |
| 7,780,242 | B2 * | 8/2010 | Sollami | 299/104 |
| 2008/0202819 | A1 | 8/2008 | Fader | |

FOREIGN PATENT DOCUMENTS

| | | |
|---|---|---|
| DE | 33 00 168 | 7/1984 |
| DE | 86 25 406 | 12/1986 |
| DE | 296 23 508 U1 | 9/1998 |
| DE | 199 83 830 T1 | 3/2002 |
| FR | 2 434 899 | 3/1980 |
| GB | 1117694 | 6/1966 |
| GB | 1117112 | 6/1968 |
| ZA | 2007/05282 | 1/2010 |

OTHER PUBLICATIONS

Examination Report from related application No. GB0802746.8, mailed Nov. 2, 2010, 2 pages.

* cited by examiner

SLEEVE FOR REVERSIBLE CUTTING TOOL

FIELD

The present disclosure relates generally to cutting tools. More specifically, the present disclosure relates to reversible cutting tools incorporating a shield over an exposed retainer. Also, the present disclosure relates to the combination of a reversible cutting tool and a sleeve and/or block holder system, to apparatus including such combinations and to a sleeve per se and to a shield per se.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

A conventional cutting tool, such as a point attack bit for mining and construction, consists of one cutting end and one retention end. In operation, the retention end is positioned in a holder and the cutting end is applied against material to be mined, excavated, moved or so forth. Operation over time wears the cutting end. Once the cutting end is worn, a user removes the cutting tool and replaces it with a new or more serviceable cutting tool.

The removed worn cutting tool is typically discarded. However, even though the cutting tool is worn at the cutting end, a majority of the remaining portions of the cutting tool are still intact, a large portion of the material of the cutting tool, e.g., the steel body, remains and non-cutting end portions of the cutting tool are still functional.

Also, for every removed cutting tool, a replacement cutting tool must be delivered to the machine. The replacement cutting tools are heavy and cumbersome and transporting cutting tools can be difficult and costly, particular when delivery is to underground locations, such as in mining operations.

Reversible cutting tools are generally known: see, e.g., U.S. Pat. Nos. 3,342,531; 3,493,268; 3,519,309; and 5,810,102 and GB 1,117,112. Typically, such cutting tools are secured in a bit holder by a retaining mechanism. These retaining mechanisms typically use a retaining device, variously and for example, a retention pin, a retention clip, a plunger or a keeper, associated with the bit holder that cooperates with a recess on a cutting tool inserted into a bore of the bit holder and that biases the cutting tool to be retained in the bit holder.

By its reversible construction, reversible cutting tools has a recess associated with each end of the tool. Thus, while one recess is inserted into the bit holder for retention, a second recess is exposed. This exposed recess is used for retention when that end is inserted into the bit holder. However, prior to its use for retention in the bit holder, the recess is exposed to wear during operation when that end of the cutting tool in used for mining or construction. Such wear can detrimentally impact the retention of the cutting tool when the cutting tool is reversed.

SUMMARY

An exemplary embodiment of a disclosed double sided tool system to be used on mining and construction equipment, for example, rotating drums, wheels, rotary cutters, or chains to cut soft and hard rock, has a cutting surface on both ends of the cutting tool. In operation, the cutting tool can be flipped around in the tool holder, e.g., a block system or a block and sleeve system, once one end is worn to expose the other end for use. A shield slides over the nose of the cutting tool and provides protection to the exposed recess and retainer while keeping the removed cutting material moving due to its free rotation around the nose of the cutting tool. The shield minimizes or prevents material from getting backed up and lodged in the recess. The shield stays on the cutting tool the same way a typical sleeve would. For example the shield is friction fit with the retainer, the shield has a groove on the inside for cooperation with a bumped retainer, or a combination of the two, can be used to hold the shield over the retainer while still allowing free rotation on the cutting tool. The shield is removed when the cutting tool is reversed.

The double-sided feature allows the cutting tool in essence to behave as two tools. Each end of the cutting tool has a dual purpose—acting as a retention shank for half the cutting tool's life and acting as a cutting tip for the other half of the cutting tool's life. Once the first end is worn, the user can extract the cutting tool from the holder and turn it so that the second end, that was previously used to hold the cutting tool inside the tool holder, is now the cutting end and the worn end is now the retention end.

An exemplary embodiment of a sleeve for inserting into a bore in a block holder of a cutting tool comprises a body with a bore longitudinally therethrough from a first end to a second end, the bore defining an inner surface, a shoulder on the first end, the shoulder having a contact face, and two grooves on the inner surface of the bore, wherein the two grooves are longitudinally spaced apart.

An exemplary embodiment of a combination comprises a reversible cutting tool with two cutting ends, a block holder with a bore, and a sleeve inserted into the bore in the block holder, wherein the sleeve includes a body with a bore longitudinally therethrough from a first end to a second end, the bore defining an inner surface, a shoulder on the first end, the shoulder having a contact face, and two grooves on the inner surface of the bore, wherein the two grooves are longitudinally spaced apart.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1A:
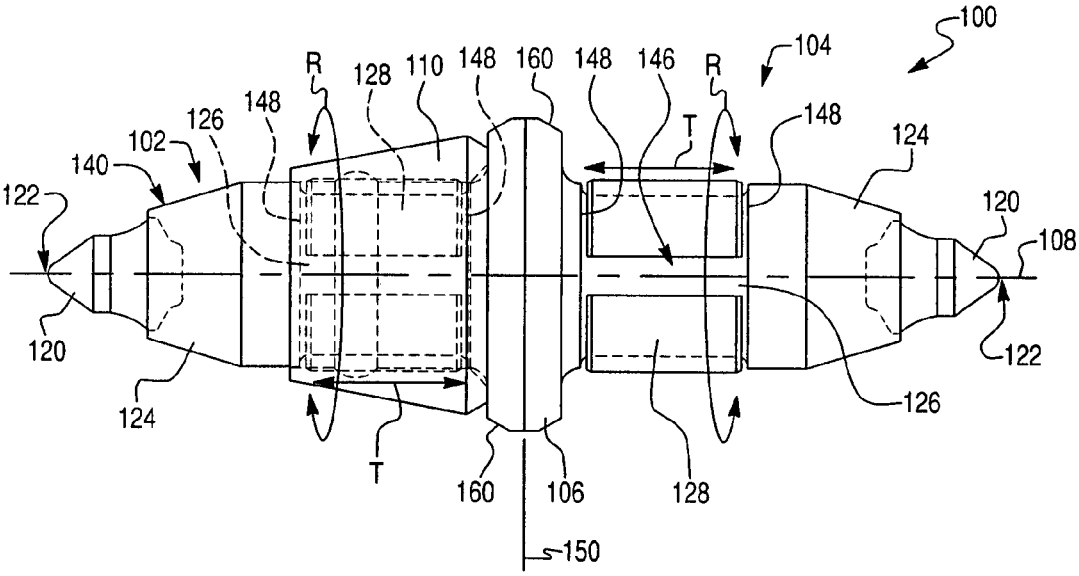
FIGS. 1A, 1B and 1C schematically illustrate various exemplary embodiments of a cutting tool.
Figure 1B:
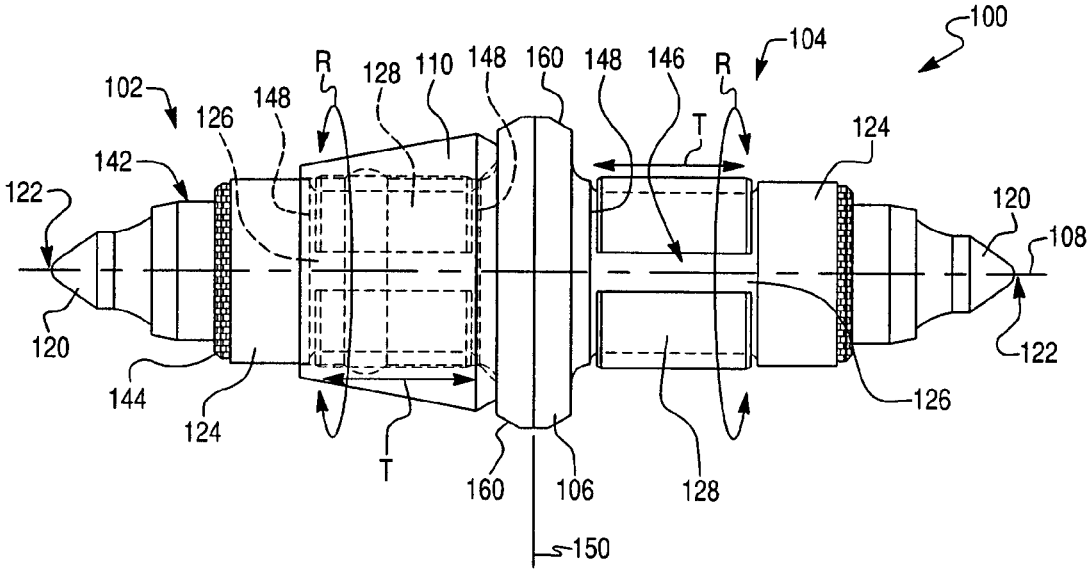
Figure 1C:
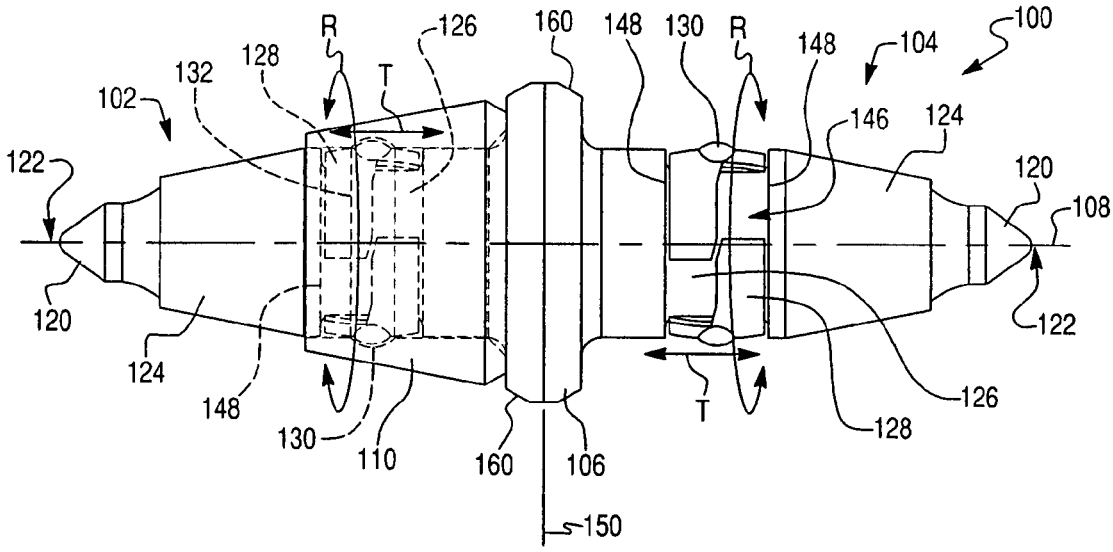

FIGS. 1A-1C schematically illustrate various exemplary embodiments of a cutting tool. In FIGS. 1A-1C, a cutting tool 100 has a first cutting end 102 and a second cutting end 104. A shoulder 106 is at the interface of the first cutting end 102 and the second cutting end 104. The first cutting end 102, the shoulder 106 and the second cutting end 104 are arranged longitudinally along common axis 108. A shield 110 is shown mounted on first cutting end 102, but can be removed from the first cutting end 102 and placed on the second cutting end 104.

Each cutting end on each cutting tool includes a cutting tip 120 at a distal end 122, a body portion 124, a recess 126 in the body portion 124 and a retainer 128 positioned in the recess 126. The cutting tip 120 is typically formed of a hard material, such as a cemented carbide, and is mounted on the body portion 124 by a suitable mounting technique, such as metallurgically bonding, brazing, and/or soldering. The body portion is formed from a steel.

FIGS. 1A-1C demonstrates the applicability of a shield to various designs of cutting ends. FIG. 1A shows a cutting end with conical transition 140 from the cutting tip 120 rearward toward the recess 126 and retainer 128 while FIG. 1B shows a stepped arrangement 142. Also in FIG. 1B, the cutting end has a ring 144 of hard material, such as a cemented carbide. Retainers 128 of various forms can be used. For example, FIG. 1C shows a retainer 128 with a protrusion 130 on the outer surface that fits into a groove 132 in an inner surface of a bore of the shield 110; FIGS. 1A and 1B show retainers 128 with a friction fit between the outer surface of the retainer and the inner surface of the bore of the shield 110.

The retainers 128, which typically are formed of, for example, a spring steel, can have a slit 146 or other feature by which the retainer can expand/contract to fit around the body portion and into the recess and to accommodate the shield being placed over the retainer. The retainer 128 on each of the first cutting end 102 and the second cutting end 104 of the cutting tool 100 are rotatably mounted in the respective recess 126. For example, the retainer 128 in recess 126 can rotate R in either direction, but translation T is limited by the edges 148. The edges 148 are wear areas. If the edges 148 wear too much during operation, then translation T will not be limited and the retainer 128 could slide off the cutting end of the cutting tool. As seen in comparing, for example, FIG. 1A and FIG. 1C, the recesses 126 for different retainers 128 can have different sizes, e.g., lengths and depths.

It is contemplated that various combinations of the above features of the cutting end design, the retainers and the recesses may be included in the disclosed cutting tool and disclosed combinations, apparatus and methods. Further, some embodiments of cutting tools have a first cutting end 102 that is a mirror image of the second cutting end 104, with a mirror plane 150 that is perpendicular to the common axis 108 and bisecting the shoulder 106, while other embodiments of cutting tools can have different cutting ends, i.e., the cutting ends on one cutting tool are not mirror images. As an example of a non-mirror image cutting tool, some applications such as trenching may use a first cutting end that is longer than a second cutting end, i.e., the first cutting end has a different gage length than the second cutting end. The first longer cutting end may be used for some aspects of the operation and then the shorter cutting end is used for other aspects, such as when excavation conditions become harder, e.g., the cutting material becomes harder. If the excavation conditions become easier again, the cutting tool cutting ends may be switched again, with the longer cutting end being placed back into operation.

Figure 2A:
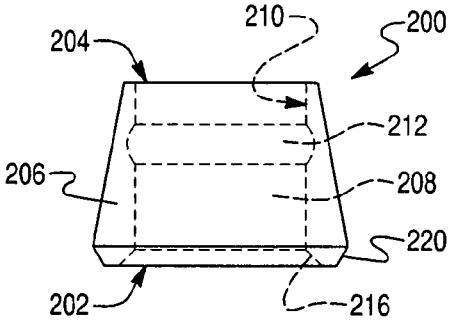
FIGS. 2A and 2B schematically illustrate various exemplary embodiments of a shield for a cutting tool.
Figure 2B:
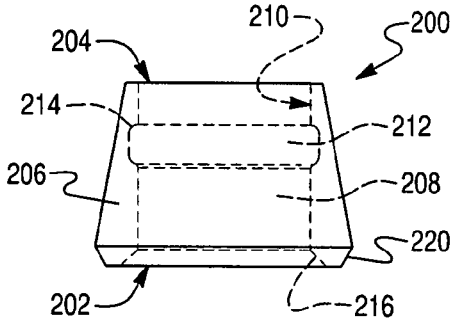

FIGS. 2A and 2B schematically illustrate various exemplary embodiments of a shield for a cutting tool. The shield 200 has a frustum shape with a base 202, a top 204 and a body 206. Special cases of the general frustum shape include a conical frustum, a pyramidal frustum, and a spherical segment. Although described herein as a frustum, it should be understood that the general shape is that of a frustum and that special cases and minor variations while maintaining the general frustum shape of a portion of a solid which lies between two parallel planes cutting the solid are within the meaning of "frustum". Further, outer side edges of the frustum can be planar, concave, convex or of a complex form or a combination of such forms. Finally, although described herein as a frustum shape, other shapes of the shield are contemplated and can be used including cylindrical shapes and barrel shapes.

The body 206 of the shield 200 has a bore 208 therethrough from the top 204 to the base 202. The bore 208 has an inner surface 210. The inner surface 210 includes a groove 212. The inner surface 210 and the groove 212 each cooperate with outer surfaces of the retainer 128, and with the protrusion 130 on the retainer 128, if present, fitting into the groove 212. The groove can take any form. For example, FIG. 2A shows the groove 212 as being part circular and FIG. 2B shows the groove 212 as rectangular with radial or chamfered corners 214. Note that, while the shield has a groove on the inner surface, the groove is not necessarily engaged by a corresponding feature on the retainer on the first cutting end in all embodiments. However, the inclusion of a groove in the shield adapts the shield for universal use with or without a protrusion on the retainer.

At the base end of the shield 200, the inner surface 210 of the bore 208 has a chamfered surface 216. The chamfered surface of the bore 208 assists in forcing the retainer 128 into the bore 208 when the shield 200 is slipped over the cutting end.

At the base end of the shield 200, an outer edge 220 is chamfered. This chamfered outer edge 220 provides a surface to receive a removal tool. For example, prongs or bifurcated portions of a removal tool can be placed under the outer edge 220 and levered against the shoulder 106 to remove the shield 200. A similar chamfer on an outer edge 160 of the shoulder 106 (see FIGS. 1A-1C) is similarly used with a suitable removal tool to allow placement of the removal tool, which is then levered against a surface of a sleeve or a block holder to remove the cutting tool from a bore of the sleeve or a bore of the block holder.

The shield can be made of a hard material, such as a steel or cemented carbide. Alternatively, because it is a wear part and a consumable, the shield can be made of a plastic material, such as neoprene or other rubbers and composites, or a combination of such materials.

Figure 3A:
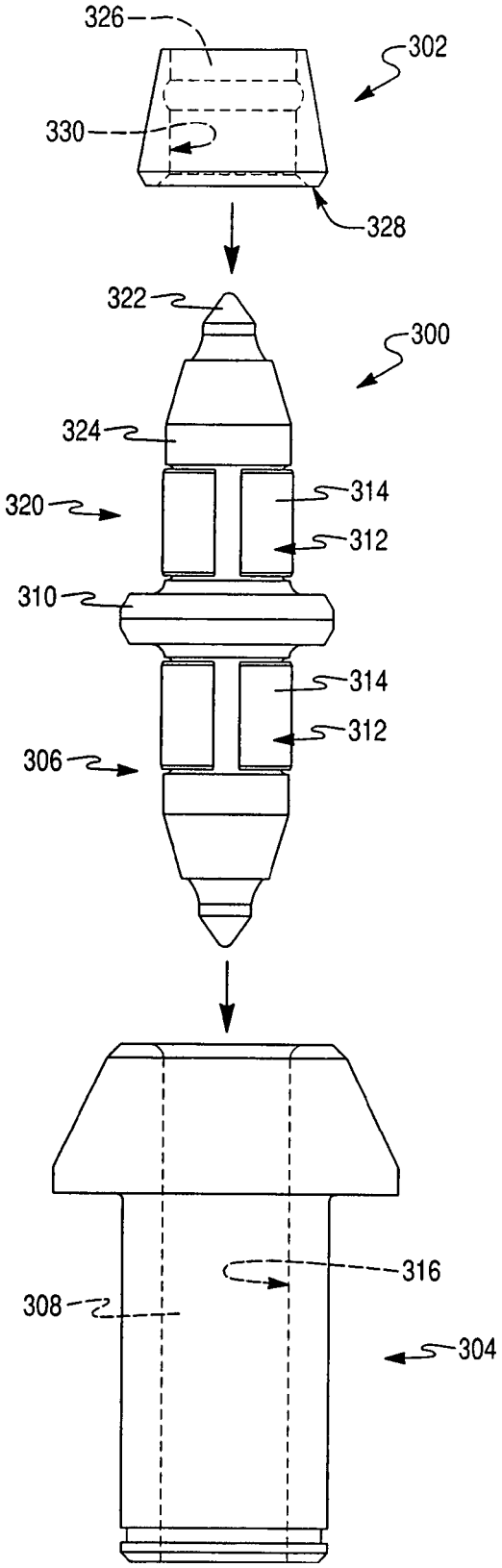
FIG. 3A schematically illustrates, in an exploded view, an exemplary embodiment of a cutting tool, a shield for a cutting tool and a sleeve and FIG. 3B schematically illustrates a cross-section of the assembled elements of FIG. 3A.

FIG. 3A schematically illustrates, in an exploded view, an exemplary embodiment of a cutting tool 300, a shield 302 for a cutting tool 300 and a sleeve 304.

In FIG. 3A, the second cutting end 306 of the cutting tool 300 is placed into a bore 308 of the sleeve 304, typically until the shoulder 310 contacts the sleeve 304, so that a friction fit is formed between the outer surface 312 of the retainer 314 on the second cutting end 306 and the inner surface 316 of the bore 308 of the sleeve 304. In the case where the retainer does not have a protrusion on the outer surface, as here, the inner surface of the bore of the sleeve can be correspondingly smooth, in this case without a corresponding groove. However, the use of a bore with an inner surface that is grooved is not precluded where the retainer is without a protrusion.

In FIG. 3A, the first cutting end 320 of the cutting tool 300 receives the shield 302. The cutting tip 322 and body portion 324 of the first cutting end 320 are placed into the opening 326 in the shield 302, typically until the base 328 contacts the shoulder 310, so that a friction fit is formed between the outer surface 312 of the retainer 314 on the first cutting end 320 and the inner surface 330 of the opening 326 in the shield 302. In the case where the retainer does not have a protrusion on the outer surface, as here, the inner surface of the opening in the shield can be correspondingly smooth. However, the use of an opening in the shield with an inner surface that is grooved is not precluded where the retainer is without a protrusion and, indeed, a shield with a groove provides universality to both the smooth retainer and the retainer with a protrusion.

Figure 3B:
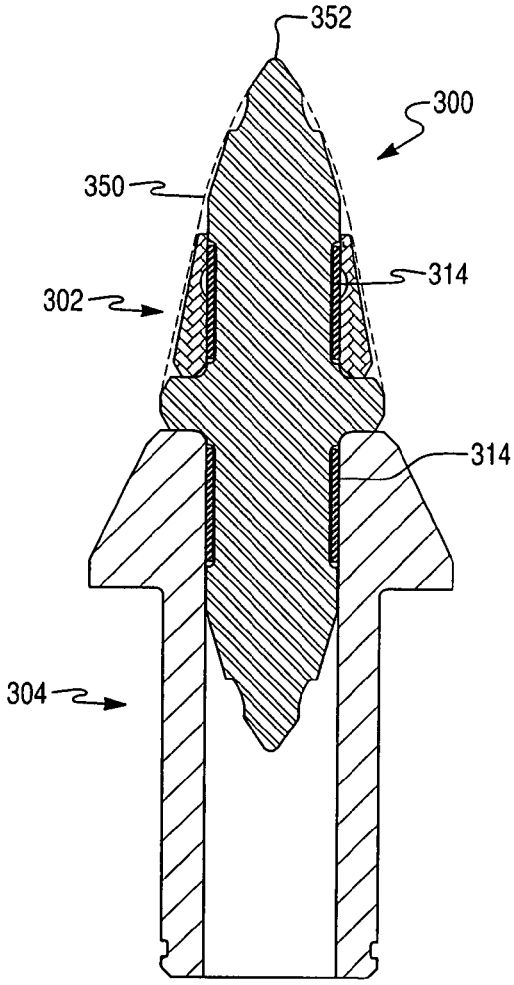

FIG. 3B schematically illustrates a cross-section of the assembled components of FIG. 3A. In this view, the friction fit between the outer surface of the retainer on the second cutting end and the inner surface of the bore of the sleeve can be seen. Further, the friction fit between the outer surface of the retainer on the first cutting end and the inner surface of the opening in the shield can be seen. Also shown in FIG. 3B, the shield covers the retainer as well as the wear edges of the recess.

Figure 4A:
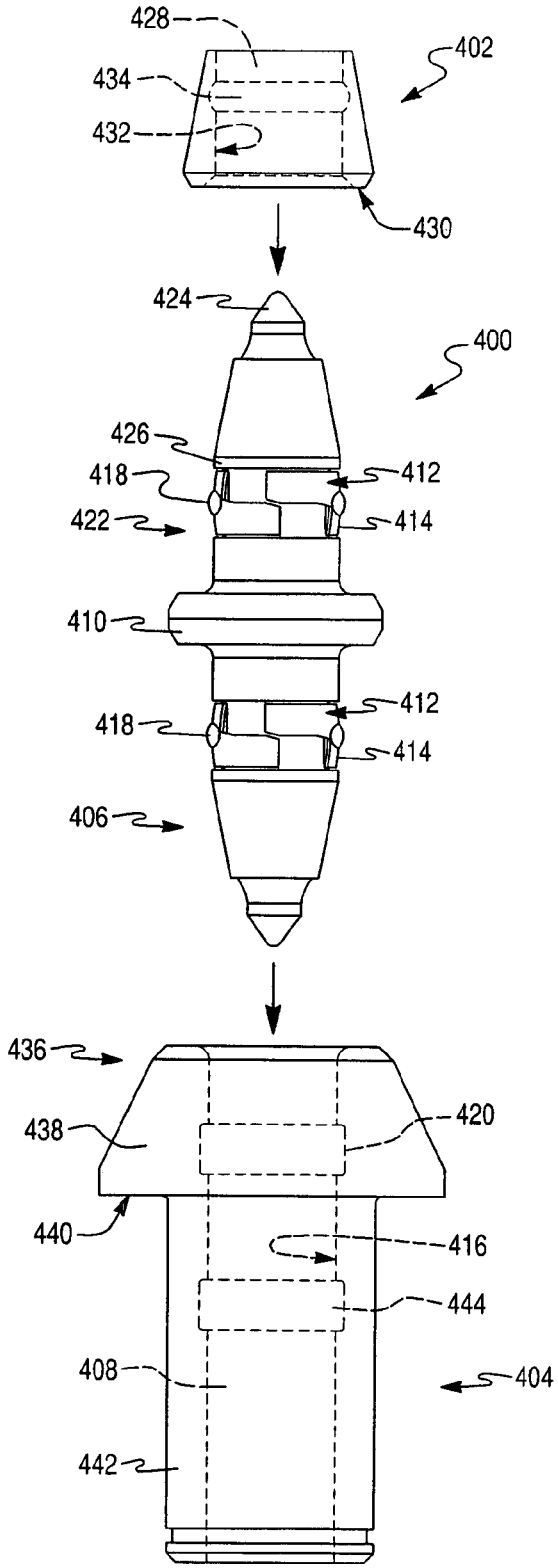
FIG. 4A schematically illustrates, in an exploded view, an exemplary embodiment of a cutting tool, a shield for a cutting tool and a sleeve and FIG. 4B schematically illustrates a cross-section of the assembled elements of FIG. 4A.

FIG. 4A schematically illustrates, in an exploded view, an exemplary embodiment of a cutting tool 400, a shield 402 for a cutting tool 400 and a sleeve 404.

In FIG. 4A, the second end 406 of the cutting tool 400 is placed into a bore 408 of the sleeve 404, typically until the shoulder 410 contacts the sleeve 404, so that a friction fit is formed between the outer surface 412 of the retainer 414 on the second end 406 and the inner surface 416 of the bore 408 of the sleeve 404. In the case where the retainer does have a protrusion 418 on the outer surface, as here, the inner surface of the bore of the sleeve can have a corresponding groove 420.

In FIG. 4A, the first cutting end 422 of the cutting tool 400 receives the shield 402. The cutting tip 424 and body portion 426 of the first cutting end 422 are placed into the opening 428 in the shield 402, typically until the base 430 contacts the shoulder 410, so that a friction fit is formed between the outer surface 412 of the retainer 414 on the first cutting end 422 and the inner surface 432 of the opening 428 in the shield 402. In the case where the retainer has a protrusion 418 on the outer surface, as here, the inner surface of the opening in the shield can have a corresponding groove 434.

Figure 4B:
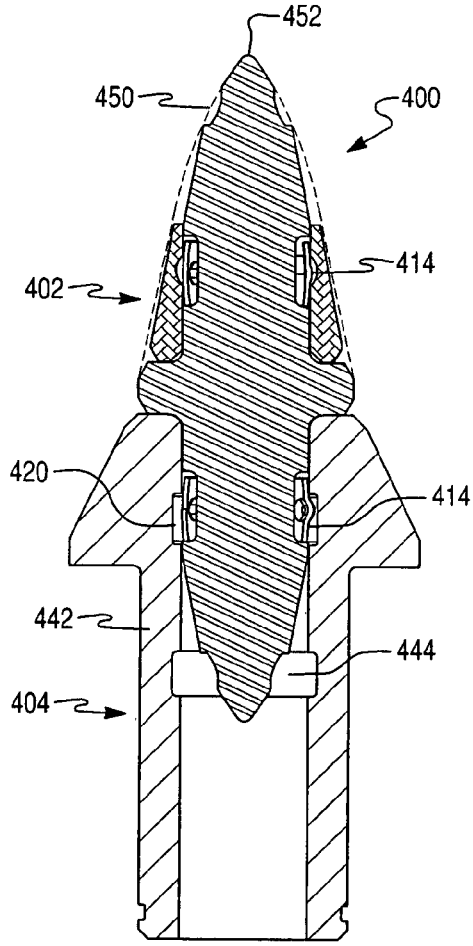

Returning to the sleeve 404 shown in FIGS. 4A and 4B, two grooves on the inner surface 416 of the bore 408 of the sleeve 404 are shown. The first groove 420 accommodates features of the retainer 412 when the second end 406 of the cutting tool 400 is inserted in the sleeve 404. An example of such a feature is the protrusion 418. The first groove is positioned toward a first end 436 of the sleeve 404. The first end 436 of the sleeve 404 also has a shoulder 438 with a contact surface 440. When assembled in a block holder for a cutting tool, the contact surface 440 is oriented toward the body of the block holder and may or may not contact the block holder. In some exemplary embodiments, the first groove 420 is located at least partially above the plane defined by the contact surface 440, i.e., longitudinally toward the first end 436 of the body 442 of the sleeve 404. In some embodiments, the first groove 420 is located completely above the plane defined by the contact surface 440. A second groove 444 accommodates features on or related to a shank of a conventional single-ended cutting tool and is suitable located along the longitudinal axis of the sleeve to accommodate mating with such features. The second groove 444 is located further from the first end 436 of the sleeve 404 than is the first groove 420. The second groove 444, for example, can be approximately at the longitudinal center of the bore 408 of the sleeve 404. Also, for example, the second groove 444 can be completely below the plane defined by the contact surface 440. A sleeve 404 with two grooves 420, 444 as depicted in FIGS. 4A and 4B can be a universal sleeve, because a two-ended cutting tool with a bumped retainer utilizes the first groove 420 and a single ended cutting tool utilizes the second groove 444. Further, cutting tools with no features requiring a groove can also be used.

FIG. 4B schematically illustrates a cross-section of the assembled elements of FIG. 4A. In this view, the friction fit between the outer surface of the retainer on the second cutting end and the inner surface of the bore of the sleeve can be seen as well as the fit between the protrusion on the retainer and the groove in the bore of the sleeve. Further, the friction fit between the outer surface of the retainer on the first cutting end and the inner surface of the opening in the shield can be seen as well as the fit between the protrusion on the retainer on the first cutting end and the groove in the inner surface of the shield. Also shown in FIG. 4B, the shield covers the retainer as well as the wear edges of the recess.

FIGS. 3B and 4B illustrate the continuous ballistic envelope of the respective cutting ends when the shield is removably mounted on the respective cutting end. For example and as illustrated in FIGS. 3B and 4B, a continuous curve 350, 450 can be drawn from the most distal portion of the cutting tip to the radially most outermost portion of the shoulder. This curve 350, 450 has a ballistic or ogive shape, where the distal end of the cutting tip corresponds to the point of the arch 352, 452 of the ogive. All of the surfaces of the first cutting end and the shield, if present, are within the envelope. In some embodiments, a portion of an outer surface of the shield correlates to a portion of the envelope. Although shown in FIGS. 3B and 4B associated with the first cutting end, a similar curve is associated with the second cutting end when the cutting tool is reversed and the shield is on the second cutting end.

Figure 5:
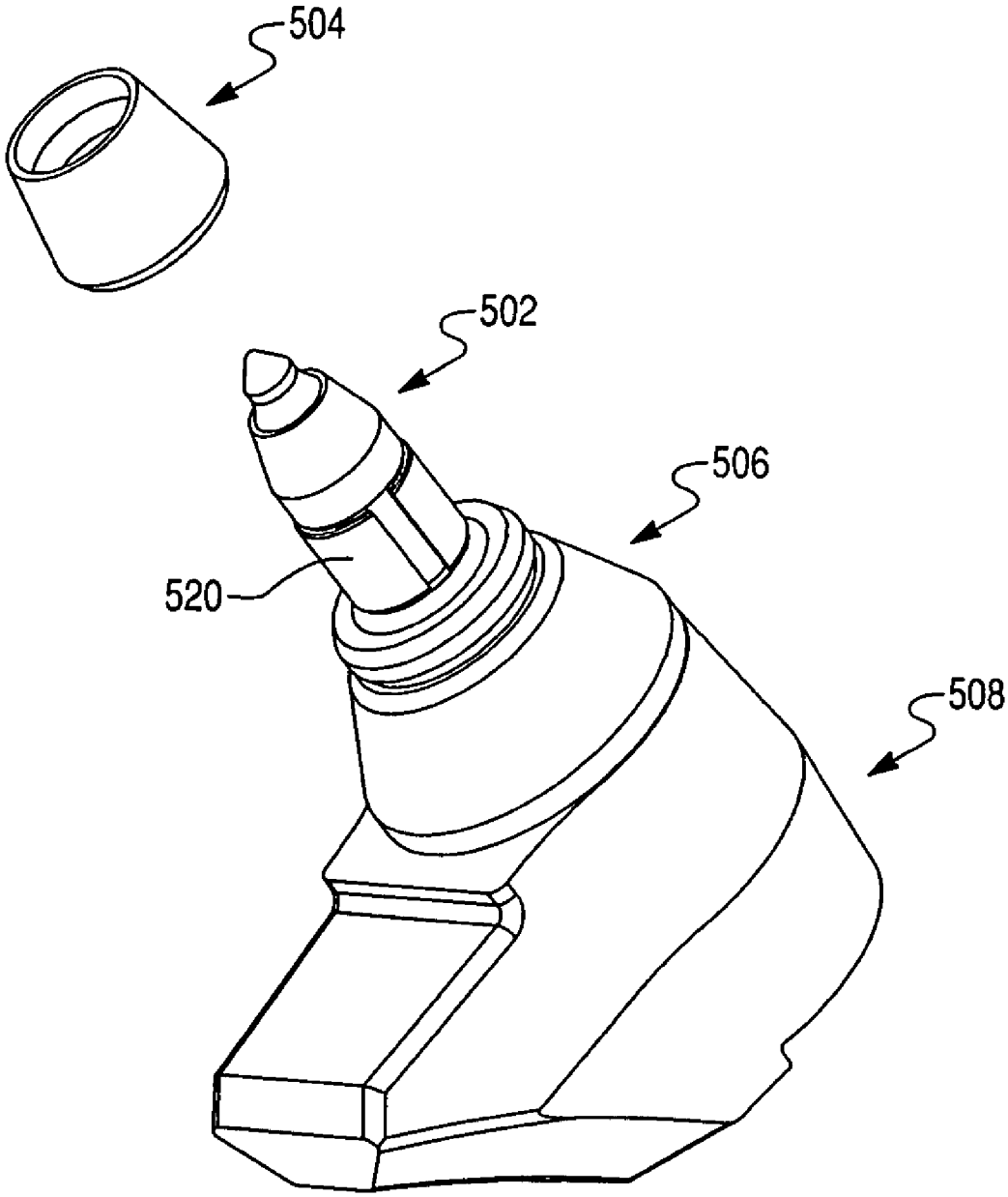
FIG. 5 is an isometric view of an assembled combination of a cutting tool, shield, optional sleeve and block holder.

FIG. 5 is an isometric view of a combination of a cutting tool 502, shield 504, optional sleeve 506 and block holder 508. In the FIG. 5 view, the second cutting end of the cutting tool has been inserted into the sleeve 506 and is not visible. The sleeve 506 has been inserted into the block holder 508. Thus and with analogy to a single ended cutting tool, the second cutting end operates as a type of shank for the first cutting end, and when the reversible cutting tool is reversed, the first cutting end operates as a type of a shank for the second cutting end. In the FIG. 5 view, the shield 504 has not yet been mounted on the first cutting end of the cutting tool 502 and the retainer 510 on the first cutting end is visible.

The combination of FIG. 5 can be mounted on an apparatus for cutting. For example, the block holder can be welded to a rotatable cutting element. An exemplary embodiment of an apparatus for cutting comprises a rotatable cutting element and the combination of a cutting tool, a shield, an optional sleeve and a block holder. The block holder is mounted on the rotatable cutting element. An example of a rotatable cutting element is a drum of a wall excavating machine. The block holder is mounted on the rotatable cutting element by, for example, welding. The rotatable cutting element can itself be on a translatable or otherwise movable arm of the apparatus. An example of a suitable apparatus with a rotatable cutting element is a Sandvik Alpine Miner AM75.

An exemplary method of cutting material employs the apparatus for cutting to engage the cutting tool against material to be removed. As the cutting tool moves in contact with the material, some of the material is removed. The exemplary method is applicable to mining, construction and excavating.

Another exemplary method of cutting material inserts a first cutting end of a cutting tool into a bore of a block holder on a rotatable cutting element of an apparatus for cutting or into a bore of a sleeve which is mounted in a block holder on a rotatable cutting element of an apparatus for cutting. The shield is then mounted on a second cutting end of the cutting tool. For example, the shield is mounted by application of manual force by, for example, a mallet. The apparatus is then operated to cut material with the second cutting end of the cutting tool. After the second cutting end is worn, the shield is removed from the second cutting end of the cutting tool and the first end of the cutting tool is removed from the bore of the block holder. As previously discussed, a removal tool can be used to remove the shield and/or the cutting tool.

The second cutting end of the cutting tool is then inserted into a bore of a block holder on a rotatable cutting element of an apparatus for cutting or into a bore of a sleeve which is mounted in a block holder on a rotatable cutting element of an apparatus for cutting. The shield, preferably the same shield as previously removed from the second cutting end but optionally a different shield, is mounted on the first cutting end of the cutting tool. The first cutting end is then ready to cut material.

In the exemplary methods, the first cutting end of the cutting tool includes a first cutting tip at a first distal end, a first body portion, a first recess in the first body portion and a first retainer positioned in the first recess, and the second cutting end of the cutting tool includes a second cutting tip at a second distal end, a second body portion, a second recess in the second body portion and a second retainer positioned in the second recess.

Inclusion of the shield upon the second use of the cutting tool is optional, as the retainer and wear edges protected by the shield are no longer going to be used if the other cutting end of the cutting tool has already been used and worn. Generally, the shield enhances the durability of the double sided cutting tool. By placing the shield over the cutting tip and recess, the shield acts as protection to the recess and wear areas thereof so that these areas will still be intact as the cutting tip wears. The shield also protects the retainer optionally installed in the recess. A user can remove the shield once that side is worn and still have a fully useable recess and/or retainer for when one uses the opposite end of the cutting tool.

During operation to cut material, the free rotation of the shield keeps the limited material that does reach the inside of the shield from remaining lodged inside the shield. The rotation will help to break up any material. The shield freely rotates because the inner surface of the retainer is rotatable in the recess while the shield is friction fit or protrusion fit to the outer surface of the retainer. Also during operation to cut material, the shield helps the cutting tool to carry higher loads than for a cutting tool without a shield. This is because the shield is in contact with the shoulder of the cutting tool. Higher side impacts will be carried from the cutting tip and be partially distributed through the shield and into the shoulder and/or the body of the sleeve and/or block holder, where there is much more support for such forces.

The disclosed cutting tools, combinations, cutting apparatus and methods improve efficiencies and economics of operations. Because each cutting tool has two cutting tips, customers would stock and transport half as many cutting tools while utilizing the same number of cutting tips. Further, less steel would be required to make one reversible cutting tool having two cutting ends compared to one conventional cutting tool having only one cutting end.

It should be understood that throughout this disclosure, inclusion of the sleeve is optional and that the second end of the cutting tool can be inserted directly into a bore in a block holder or any other bore for supporting cutting tools. In that case and for example, the bore of the block holder or other support operates similarly to that of the bore of the sleeves described herein in conjunction with FIGS. 3A-3B and 4A-4B and has similar features. Further, when a sleeve is present, other features in addition to those described here can be included, for example, other features of conventional sleeves used in sleeve and block holders.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A sleeve for inserting into a bore in a block holder of a cutting tool, the sleeve comprising:

a body with a bore longitudinally therethrough from a first end to a second end, the bore defining an inner surface;

a shoulder on the first end, the shoulder having a contact surface; and two grooves on the inner surface of the bore, wherein the two grooves are longitudinally spaced apart, each groove extending laterally of the longitudinal direction of the bore for only a portion of a lateral thickness of the body.

2. The sleeve of claim 1, wherein a first of the grooves is positioned toward the first end of the sleeve.

3. The sleeve of claim 1, wherein a first of the grooves is located at least partially above a plane defined by the contact surface.

4. The sleeve of claim 3, wherein a second of the grooves is approximately at a longitudinal center of the bore of the sleeve.

5. The sleeve of claim 3, wherein a second of the grooves is completely below the plane defined by the contact surface.

6. The sleeve of claim 1, wherein a first of the grooves is located completely above a plane defined by the contact surface.

7. The sleeve of claim 6, wherein a second of the grooves is approximately at a longitudinal center of the bore of the sleeve.

8. The sleeve of claim 6, wherein a second groove of the grooves is completely below the plane defined by the contact surface.

9. A combination comprising:

a reversible cutting tool with two cutting ends;

a block holder with a bore; and a sleeve inserted into the bore in the block holder, wherein the sleeve includes:

a body with a bore longitudinally therethrough from a first end to a second end, the bore defining an inner surface;

a shoulder on the first end, the shoulder having a contact surface; and two grooves on the inner surface of the bore, wherein the two grooves are longitudinally spaced apart, each groove extending laterally of the longitudinal direction of the bore for only a portion of a lateral thickness of the body.

10. The combination of claim 9, wherein a first of the grooves is positioned toward the first end of the sleeve.

11. The combination of claim 9, wherein a first of the grooves is located at least partially above a plane defined by the contact surface.

12. The combination of claim 11, wherein a second of the grooves is approximately at a longitudinal center of the bore of the sleeve.

13. The combination of claim 11, wherein a second of the grooves is completely below the plane defined by the contact surface.

14. The combination of claim 9, wherein a first of the grooves is located completely above a plane defined by the contact surface.

15. The combination of claim 14, wherein a second of the grooves is approximately at a longitudinal center of the bore of the sleeve.

16. The combination of claim 14, wherein a second of the grooves is completely below the plane defined by the contact surface.

17. The combination of claim 9, comprising a shield, wherein the reversible cutting tool includes a retainer on each of the two cutting ends, wherein the shield is removably mounted on a first of the two cutting ends and covers the retainer, and wherein a second of the two cutting ends is inserted into the bore in the sleeve.

18. The combination of claim 17, wherein an inner surface of a first retainer is rotatably mounted about a first recess in a first body portion of the first cutting end and an outer surface of the first retainer is friction fit to the inner surface of a bore of the shield.

19. The combination of claim 18, wherein an inner surface of a second retainer is rotatably mounted about a second recess in a second body portion of the second cutting end.

20. The combination of claim 17, wherein the shield has a frustum shape with a base, a top and a body, wherein the body has a bore therethrough from the top to the base.

21. The combination of claim 17, wherein the shield has a cylindrical shape or a barrel shape with a base, a top and a body, wherein the body has a bore therethrough from the top to the base.

22. An apparatus for cutting, the apparatus comprising a rotatable cutting element and the combination of claim 9, wherein the block holder is mounted on the rotatable cutting element.

23. An apparatus for cutting, the apparatus comprising a rotatable cutting element and the combination of claim 17, wherein the block holder is mounted on the rotatable cutting element.

24. A sleeve for inserting into a bore in a block holder of a cutting tool, the sleeve comprising:

a body with a bore longitudinally therethrough from a first end to a second end, the bore defining an inner surface;

a shoulder on the first end, the shoulder having a contact surface;

at least one groove on the inner surface of the bore, wherein the at least one groove is located at least partially above a plane defined by the contact surface; and a second groove on the inner surface of the bore, wherein the second groove is longitudinally spaced apart from the at least one groove, the at least one groove and the second groove extending laterally of the longitudinal direction of the bore for only a portion of a lateral thickness of the body.

25. The sleeve of claim 24, wherein the second groove is completely below the plane defined by the contact surface.

26. The sleeve of claim 25, wherein the second groove is approximately at a longitudinal center of the bore of the sleeve.

27. The sleeve of claim 24, wherein the at least one groove is located completely above the plane defined by the contact surface.

28. The sleeve of claim 27, wherein the second groove is completely below the plane defined by the contact surface.

29. A combination comprising:

a reversible cutting tool with two cutting ends;

a block holder with a bore; and a sleeve inserted into the bore in the block holder, wherein the sleeve includes:

a body with a bore longitudinally therethrough from a first end to a second end, the bore defining an inner surface;

a shoulder on the first end, the shoulder having a contact surface;

at least one groove on the inner surface of the bore, wherein the at least one groove is located at least partially above a plane defined by the contact surface; and a second groove on the inner surface of the bore, wherein the second groove is longitudinally spaced apart from the at least one groove, the at least one groove and the second groove extending laterally of the longitudinal direction of the bore for only a portion of a lateral thickness of the body.

30. The combination of claim 29, wherein the second groove is completely below the plane defined by the contact surface.

31. The combination of claim 30, wherein a the second groove is approximately at a longitudinal center of the bore of the sleeve.

32. The combination of claim 29, wherein the at least one groove is located completely above a plane defined by the contact surface.

33. The combination of claim 14, wherein the second groove is completely below the plane defined by the contact surface.

34. The combination of claim 29, wherein a first end of the reversible cutting tool is inserted into the bore in the sleeve and wherein a retainer on the first end of the reversible cutting tool cooperates with the at least one groove on the inner surface of the bore in the sleeve to retain the reversible cutting tool in the bore of the sleeve.

35. The combination of claim 34, comprising a shield mounted on the second end of the reversible cutting tool.

36. An apparatus for cutting, the apparatus comprising a rotatable cutting element and the combination of claim 34, wherein the block holder is mounted on the rotatable cutting element.

37. The combination of claim 29, wherein a first end of the reversible cutting tool is inserted into the bore in the sleeve, wherein a retainer on the first end of the reversible cutting tool includes a slit, and wherein the retainer is compressible to allow insertion of the first end of the reversible cutting tool into the bore and is expandable to be positioned in the at least one groove on the inner surface of the bore in the sleeve.

38. The combination of claim 37, comprising a shield mounted on the second end of the reversible cutting tool.

39. An apparatus for cutting, the apparatus comprising a rotatable cutting element and the combination of claim 37, wherein the block holder is mounted on the rotatable cutting element.

40. An apparatus for cutting, the apparatus comprising a rotatable cutting element and the combination of claim 29, wherein the block holder is mounted on the rotatable cutting element.

* * * * *